US011388797B2

(12) United States Patent
Van Bommel et al.

(10) Patent No.: US 11,388,797 B2
(45) Date of Patent: Jul. 12, 2022

(54) LIGHTING SYSTEM WITH CONNECTED LIGHT SOURCES

(71) Applicant: SIGNIFY HOLDING B.V., Eindhoven (NL)

(72) Inventors: Ties Van Bommel, Horst (NL); Rifat Ata Mustafa Hikmet, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/288,945

(22) PCT Filed: Oct. 21, 2019

(86) PCT No.: PCT/EP2019/078561
§ 371 (c)(1),
(2) Date: Apr. 27, 2021

(87) PCT Pub. No.: WO2020/088971
PCT Pub. Date: May 7, 2020

(65) Prior Publication Data

US 2021/0392728 A1 Dec. 16, 2021

(30) Foreign Application Priority Data

Oct. 29, 2018 (EP) ..... 18203088

(51) Int. Cl.
*H05B 45/20* (2020.01)

(52) U.S. Cl.
CPC ..... *H05B 45/20* (2020.01)

(58) Field of Classification Search
CPC ..... H05B 45/10; H05B 45/20; H05B 45/22; H05B 47/11; H05B 47/115; Y02B 20/40; G05B 2219/163; G05B 2219/2642
See application file for complete search history.

(56) References Cited

U.S. PATENT DOCUMENTS 7,828,463 B1 11/2010 Willis
10,772,173 B1 * 9/2020 Bewick ..... H05B 45/20
(Continued)

FOREIGN PATENT DOCUMENTS

JP 2013191522 A 9/2013
JP 2016129126 A 7/2016

*Primary Examiner* — Haissa Philogene
(74) *Attorney, Agent, or Firm* — Daniel J. Piotrowski

(57) ABSTRACT

A lighting system (1) is disclosed, comprising at least one first light source (L1; 3; 4) and at least one second light source (L2; 3; 4) and at least one control unit (2). The at least one control unit (2) is configured to control the at least one first light source (L1; 3; 4) and the at least one second light source (L2; 3; 4), respectively, by changing at least the luminous flux of the emitted light, between at least a first state and a second state of the at least one first light source (L1; 3; 4) and the at least one second light source (L2; 3; 4), respectively, such that, for each of the at least one first light source (L1; 3; 4) and the at least one second light source (L2; 3; 4), the luminous flux of light emitted by the light source when in the second state is lower than the luminous flux of light emitted by the light source when in the first state. Light emitted by each of the at least one first light source (L1; 3; 4) when in the second state has a lower color temperature than light emitted by the first light source (L1; 3; 4) when in the first state and light emitted by each of the at least one second light source (L2; 3; 4) when in the second state has a higher color temperature than light emitted by the second light source (L2; 3; 4) when in the first state.

15 Claims, 5 Drawing Sheets

(56) References Cited

U.S. PATENT DOCUMENTS

| | | | | |
|---|---|---|---|---|
| 2010/0102759 | A1 | 4/2010 | Donners et al. | |
| 2016/0095188 | A1* | 3/2016 | Verberkt | H05B 47/11 315/151 |
| 2016/0095192 | A1* | 3/2016 | Vangeel | H05B 45/345 315/153 |
| 2016/0374176 | A1 | 12/2016 | Van Der Poel | |
| 2017/0142809 | A1 | 5/2017 | Paolini et al. | |
| 2020/0284883 | A1* | 9/2020 | Ferreira | G01S 7/4816 |

* cited by examiner

LIGHTING SYSTEM WITH CONNECTED LIGHT SOURCES

CROSS-REFERENCE TO PRIOR APPLICATIONS

This application is the U.S. National Phase application under 35 U.S.C. § 371 of International Application No. PCT/EP2019/078561, filed on Oct. 21, 2019, which claims the benefit of European Patent Application No. 18203088.2, filed on Oct. 29, 2018. These applications are hereby incorporated by reference herein.

TECHNICAL FIELD

The present invention relates to a lighting system comprising a plurality of light sources and a control unit communicatively connected with the light sources.

BACKGROUND

Lamps, luminaires, lighting modules or lighting systems with controllable light sources such as light-emitting diodes (LEDs) may be communicatively connected with a control unit or controller, e.g., in wireless fashion using radio frequency (RF) communication techniques or means. Such lamps, luminaires, lighting modules or lighting systems will in the following be referred to as 'connected' lamps, luminaires, lighting modules or lighting systems, or 'connected' LED lamps, luminaires, lighting modules or lighting systems in case of including one or more LEDs. As used herein, the term "LED lamp" encompasses LED modules or the like. RF communication techniques or means may for example employ or comprise one or more RF antennas. The operation of the light sources of the lamp may be controlled for example by means of the control unit or controller transmitting control signaling to the lamp. This may be particularly desirable for lamps capable of emitting light of different colors, such as, for example, multicolor filament lamps, in order to facilitate or allow for adjusting the color of the light emitted by the lamp. In alternative or in addition, dimming of the light source(s) of the lamp, or activation/deactivation of the light source(s) of the lamp, may be controlled (e.g., based on output from a sensor that may be included in the lamp) by means of the control unit or controller transmitting control signaling to the lamp.

SUMMARY

By the provisioning of connected lamps, luminaires, lighting modules or lighting systems, such as, for example, connected LED lamps, luminaires, lighting modules or lighting systems, new functionalities may be facilitated or enabled. One new functionality is in the field of nightlights. The light emitted from nightlights generally has a much lower intensity than light emitted from other types of light sources (e.g., light bulbs or luminaires). Nightlights may be placed in bedrooms. The intensity of light emitted from nightlights is usually just enough for a person in the bedroom to make out the layout of the bedroom and the objects in the bedroom, but not so high that it would stop the person from falling asleep. Nightlights may be particularly helpful for children, in that if they wake up during the night, they do not find themselves in total darkness. The light emitted by the nightlights may be perceived by a person as moonlight if waking up during the night.

In view of the above discussion, a concern of the present invention is to provide, or at least facilitate providing, a nightlight functionality in connected lamps, luminaires, lighting modules or lighting systems.

To address at least one of this concern and other concerns, a lighting system and a method in a lighting system in accordance with the independent claims are provided. Preferred embodiments are defined by the dependent claims.

According to a first aspect of the present invention, a lighting system is provided. The lighting system comprises at least one first light source and at least one second light source. Each of the at least one first light source and the at least one second light source is controllable so as to emit light having at least a controllable luminous flux. Each of the at least one first light source and the at least one second light source is configured such that the color temperature of light emitted therefrom may vary. The lighting system comprises at least one control unit (which in alternative may be referred to as a control and processing unit, or a processing unit). The at least one control unit is communicatively connected with the at least one first light source and with the at least one second light source. The at least one control unit is configured to control each of the at least one first light source and the at least one second light source at least with respect to luminous flux of emitted light therefrom. The at least one control unit is configured to control the at least one first light source and the at least one second light source, respectively, by changing at least the luminous flux of the emitted light, between at least a first state and a second state of the at least one first light source and the at least one second light source, respectively, such that, for each of the at least one first light source and the at least one second light source, the luminous flux of light emitted by the light source when in the second state is lower than the luminous flux of light emitted by the light source when in the first state. The at least one control unit is configured to control the at least one first light source and the at least one second light source, respectively, between the first state and the second state of the at least one first light source and the at least one second light source, respectively, during respective time periods which are at least in part overlapping. Light emitted by each of the at least one first light source when in the second state has a lower color temperature than light emitted by the first light source when in the first state, and light emitted by each of the at least one second light source when in the second state has a higher color temperature than light emitted by the second light source when in the first state.

Possibly, the at least one first light source and the at least one second light source, respectively, may be controlled between the first state and the second state of the at least one first light source and the at least one second light source, respectively, at the same, or substantially the same, time(s).

The "first state" may in alternative be referred to as a "first setting", or "high setting" (e.g., with respect to the luminous flux of the emitted light). The "second state" may in alternative be referred to as a "second setting", or "low setting" (e.g., with respect to the luminous flux of the emitted light). Each of the at least one first light source and the at least one second light source may thus selectively be in a first state thereof or in a second state thereof. For example, the at least one first light source and the at least one second light source, respectively, may be controlled by changing at least the luminous flux of the emitted light, between the first state and the second state of the at least one first light source and the at least one second light source, respectively, such that the luminous flux of light emitted by the at least one first light source and the at least one second light source, respectively, when in the first state is higher than when in the second state.

By way of the at least one control unit being communicatively connected with the at least one first light source and with the at least one second light source, and with the at least one control unit being configured to control each of the at least one first light source and the at least one second light source, the at least one first light source and the at least one second light source can be considered as constituting so called connected light sources (e.g., connected lamps, or connected luminaires), as mentioned in the foregoing. The at least one control unit may control operation of the light sources for example by means of the at least one control unit transmitting at least one control signal, control signaling, or some other type of control message(s), which may be received by the light sources.

By way of the at least one first light source and the at least one second light source, respectively, being controllable between at least the first state and the second state of the at least one first light source and the at least one second light source, respectively, and by the light emitted by each of the at least one first light source when in the second state has a lower color temperature than light emitted by the first light source when in the first state and light emitted by each of the at least one second light source when in the second state has a higher color temperature than light emitted by the second light source when in the first state, a nightlight functionality of the lighting system may be implemented or realized.

For example, the at least one first light source and the at least one second light source, respectively, may be controlled from the first state to the second state of the at least one first light source and the at least one second light source, respectively (or vice versa), during respective time periods which are at least in part overlapping. For example, the at least one control unit may be configured to carry out such controlling of the at least one first light source and the at least one second light source. It is to be understood that the process of controlling of the at least one first light source between the first and second states thereof (e.g., from the first state to the second state) and the process of controlling of the at least one second light source between the first and second states thereof (e.g., from the first state to the second state) must not necessarily begin or end at the same time (but they may do so), but may begin and/or end at different times.

As indicated in the foregoing, the luminous flux of light emitted by the at least one first light source and the at least one second light source, respectively, when in the first state may be higher than when in the second state, for example.

While the foregoing description and also the description in the following refer to luminous flux, such as luminous flux of light emitted by the at least one first light source and the at least one second light source, respectively, it is to be understood that the foregoing description and also the description in the following apply mutatis mutandis to, e.g., intensity, such as intensity of light emitted by the at least one first light source and the at least one second light source, respectively.

The lighting system may for example be arranged in a room, such as, for example, a bedroom, wherein the first state of the at least one first light source and the at least one second light source may be employed during waking hours, and the second state of the at least one first light source and the at least one second light source may be employed during sleeping hours, usually during the night. The first state of the at least one first light source and the at least one second light source, respectively, may represent a preference of users with respect to artificial lighting conditions, which may be used when executing a task such as reading, cooking, etc. The second state of the at least one first light source and the at least one second light source, respectively, may represent (or be used to mimic) daylight and/or natural light, such as for example, representing the color temperature of moonlight and/or color temperature of sunlight at sunset and/or sunrise.

When the at least one first light source and the at least one second light source are in the first state of the at least one first light source and the at least one second light source, respectively, e.g., when the luminous flux of the emitted light may be lower, light emitted by, e.g., the at least one second light source may have a color temperature that may represent the color temperature of moonlight.

For example, if the lighting system is arranged in a room, such as, for example, a bedroom, the at least one second light source may be arranged in the ceiling of the room, and the at least one first light source may be arranged on the floor of the room or on a table or nightstand or the like.

The at least one first light source and the at least one second light source may be arranged at a distance from each other. The at least one first light source and the at least one second light source may be arranged such that the light emitted therefrom is perceivable by a person in the room (or in another location at or in the lighting system may be arranged). The at least one first light source and the at least one second light source may be arranged or controlled so that the at least one first light source and the at least one second light source are emitting light at the same time, for example during at least in part overlapping time periods. The at least one first light source and the at least one second light source may be arranged or controlled so that the at least one first light source is in the first state thereof and the at least one second light source is in the first state thereof at the same time, for example during at least in part overlapping time periods, and such the at least one first light source is in the second state thereof and the at least one second light source is in the second state thereof at the same time, for example during at least in part overlapping time periods.

For example, the at least one first light source and the at least one second light source may be configured in a particular manner such that, when the at least one control unit controls the at least one first light source and the at least one second light source, respectively, by changing at least the luminous flux of the emitted light, between the first state and the second state, light emitted by each of the at least one first light source when in the second state has a lower color temperature than light emitted by the first light source when in the first state, and light emitted by each of the at least one second light source when in the second state has a higher color temperature than light emitted by the second light source when in the first state. In alternative or in addition, the at least one first light source and the at least one second light source may be controllable so as to emit light having a controllable color temperature, and they may be controlled (e.g., by the at least one control unit) such that light emitted by each of the at least one first light source when in the second state has a lower color temperature than light emitted by the first light source when in the first state, and light emitted by each of the at least one second light source when in the second state has a higher color temperature than light emitted by the second light source when in the first state. Thus, the at least one control unit may be configured to control each of the at least one first light source and the at least one second light source with respect to color temperature of emitted light therefrom, for example. The change in color temperature light emitted by each of the at least one first light source between the first and second states thereof may be gradual, for example linear or exponential. The change in color temperature light emitted by each of the at least one second light source between the first and second states thereof may be gradual, such as, for example, linear or exponential.

The at least one first light source and the at least one second light source, respectively, may be controlled between the first state and the second state of the at least one first light source and the at least one second light source, respectively, by gradually changing at least the luminous flux of the light emitted by the at least one first light source and the at least one second light source, respectively. The gradual change (e.g., decrease) in at least the luminous flux of the light emitted by the at least one first light source and the at least one second light source, respectively, may for example be linear or exponential. For example, the at least one control unit may be configured to carry out such controlling of the at least one first light source and the at least one second light source.

The at least one first light source and the at least one second light source, respectively, may be controlled between the first state and the second state of the at least one first light source and the at least one second light source, respectively, by continuously changing at least the luminous flux of the light emitted by the at least one first light source and the at least one second light source, respectively. For example, the at least one control unit may be configured to carry out such controlling of the at least one first light source and the at least one second light source. As the luminous flux of the light emitted by the at least one first light source and the at least one second light source, respectively, is changed continuously (e.g., dimmed), the color temperature of the light emitted by the at least one first light source and the at least one second light source, respectively, may conform, or substantially conform, to a black body locus (BBL), i.e. white light. All of the color points on the BBL are pure white and result from a mixture of a variety of visible light wavelengths. Thus, as the luminous flux of the light emitted by the at least one first light source and the at least one second light source, respectively, is changed continuously, both the at least one first light source and the at least one second light source may follow the BBL. Following the BBL may mimic a naturally occurring effect in how the color temperature of sunlight changes during the course of a day.

By the color temperature of the light emitted by the at least one first light source and the at least one second light source, respectively, conforming to, or following (or substantially conforming to or following) to the BBL as the luminous flux of the light emitted by the at least one first light source and the at least one second light source, respectively, is changed continuously, it is meant that the color temperature of the light emitted by the at least one first light source and the at least one second light source, respectively, follows a path in a chromaticity diagram that is coincident, or substantially coincident, with the BBL in the chromaticity diagram. The color temperature of the light emitted by the at least one first light source and the at least one second light source, respectively, must not necessarily follow a path in a chromaticity diagram that is exactly coincident with the BBL, but some deviation therefrom, e.g., by a few SDCM (Standard Deviation Color Matching), may be allowed. The chromaticity diagram may for example be a CIE 1931 xy chromaticity diagram. The color temperature of the light emitted by the at least one first light source and the at least one second light source, respectively, may for example be allowed to deviate from the BBL within 15 SDCM from the BBL, or within 10 SDCM from the BBL, or within 8 SDCM or less from the BBL.

SDCM may be referred to as a "MacAdam eclipse". A so called 1-step MacAdam eclipse defines a zone in the CIE 1931 xy chromaticity diagram within which a human eye generally is unable to discern a difference in color temperature of the light.

As the luminous flux of the light emitted by the at least one first light source and the at least one second light source, respectively, is changed continuously (e.g., dimmed), the color temperature of the light emitted by the at least one first light source and the color temperature of the at least one second light source may follow the BBL in opposite directions along the BBL.

Light emitted by the at least one first light source and the at least one second light source, respectively, may for example have a CRI (Color Rendering Index) of at least 70, or at least 80, or at least 85 or more, such as, for example, 90 or 92.

A difference between color temperature of the light emitted by each of the at least one first light source when in the first and second states may be larger than a difference between color temperature of the light emitted by each of the at least one second light source when in the first and second states.

The first state of the at least one first light source and the at least one second light source may be employed during waking hours, which may be referred to as a waking hours state. For example, the color temperature of light emitted by the at least one first light source and/or the at least one second light source when in the first state may be in a range from 2500 K to 3700 K, which may be a preferred color temperature range for users during waking hours. As mentioned in the foregoing, the first state of the at least one first light source and the at least one second light source, respectively, may represent a preference of users with respect to artificial lighting conditions, which may be used when executing a task such as reading, cooking, etc. The second state of the at least one first light source and the at least one second light source may be employed during sleeping hours, usually during the night. As also mentioned in the foregoing, the second state of the at least one first light source and the at least one second light source, respectively, may represent (or be used to mimic) daylight and/or natural light, such as for example, representing the color temperature of moonlight and/or color temperature of sunlight at sunset and/or sunrise. For example, the color temperature of light emitted by the at least one first light source when in the second state may be below 2350 K, which represents the color temperature of sunlight at sunset and/or sunrise and which may be referred to as a sunset and/or sunrise state, and the color temperature of light emitted by the at least one second light source when in the second state may be in a range from 3900 K to 4300 K, which represents the color temperature of moonlight and which may be referred to as a moonlight state. Preferences of users with respect to lighting may vary in different parts of the world. Depending on preferences of users with respect to colder or warmer light and higher or lower luminous flux of the light, the preferences of users with respect to difference in color temperature between the waking hours state and the sunset and/or sunrise state may be smaller in some countries as compared to in other countries. Likewise, the preferences of users with respect to difference in color temperature between the waking hours state and the moonlight state may be smaller in some countries as compared to in other countries. This may be accommodated by means of a difference between color temperature of the light emitted by each of the at least one first light source when in the first and second states being larger than a difference between color temperature of the light emitted by each of the at least one second light source when in the first and second states.

The at least one first light source and the at least one second light source, respectively, may be controlled, such that the luminous flux of the light emitted by the at least one first light source and the at least one second light source, respectively, when in the first state is the same, or substantially the same. For example, the at least one control unit may be configured to carry out such controlling of the at least one first light source and the at least one second light source. By the luminous flux of the light emitted by the at least one first light source and the at least one second light source, respectively, when in the first state being the same, it is not necessarily meant that the luminous flux of the light emitted by the at least one first light source and the at least one second light source, respectively, when in the first state are exactly the same, but some deviation, e.g., by a few percent, may be allowed. By means of the at least one first light source and the at least one second light source, respectively, being controlled such that the luminous flux of the light emitted by the at least one first light source and the at least one second light source, respectively, when in the first state is the same, or substantially the same, users (of the lighting system) may not perceive any difference in luminous flux of the light emitted by the at least one first light source and the at least one second light source, respectively, when in the first state (e.g., the waking hours state).

The at least one first light source and the at least one second light source, respectively, may be controlled by changing at least the luminous flux of the emitted light, between the first state and the second state of the at least one first light source and the at least one second light source, respectively, such that the luminous flux of light emitted by the at least one first light source and the at least one second light source, respectively, when in the first state is higher than when in the second state. For example, the at least one control unit may be configured to carry out such controlling of the at least one first light source and the at least one second light source. Thus, the "first state" may be referred to as a "high setting", with respect to the luminous flux of the emitted light, and the "second state" may be referred to as a "low setting", with respect to the luminous flux of the emitted light. As per the foregoing description, the first state of the at least one first light source and the at least one second light source may be employed during waking hours, which may be referred to as a waking hours state, and the second state of the at least one first light source and the at least one second light source may be referred to as a sunset and/or sunrise state and a moonlight state, respectively.

The at least one first light source and the at least one second light source, respectively, may be controlled by changing at least the luminous flux of the emitted light, between the first state and the second state of the at least one first light source and the at least one second light source, respectively, such that the luminous flux of light emitted by the at least one first light source and the at least one second light source, respectively, when in the first state is higher than when in the second state. The luminous flux of light emitted by the at least one first light source when in the second state may be zero, or substantially zero, and the luminous flux of light emitted by the at least one second light source when in the second state may be non-zero. For example, the at least one control unit may be configured to carry out such controlling of the at least one first light source and the at least one second light source. By means of such controlling of the at least one first light source and the at least one second light source, users may at a certain point in time, when the at least one first light source and the at least one second light source are both in the second state thereof, not be able to perceive any light from the at least one first light source, but only from the at least one second light source. As per the foregoing description, the second state of the at least one first light source and the at least one second light source may be referred to as a sunset and/or sunrise state and a moonlight state, respectively, and may represent the color temperature of sunlight at sunset and/or sunrise and of moonlight, respectively. Thus, users may at a certain point in time, when the at least one first light source and the at least one second light source are both in the second state thereof, not be able to perceive any 'sunset and/or sunrise light' but only 'moonlight'. By the luminous flux of light emitted by the at least one first light source when in the second state being zero, it is not necessarily meant that the luminous flux of light emitted by the at least one first light source when in the second state is exactly zero. Some relatively small luminous flux of light emitted by the at least one first light source may be allowed, but should preferably be so low that a user in the vicinity of the at least one first light source is not able to perceive it, or is just barely able to perceive it, with the naked eye.

The at least one first light source and the at least one second light source, respectively, may be controlled by changing at least the luminous flux of the emitted light, between the first state and the second state of the at least one first light source and the at least one second light source, respectively, such that the luminous flux of light emitted by the at least one first light source and/or the at least one second light source when in the first state is in a range from (about) 300 lumen (lm) to (about) 5000 lm, for example from (about) 350 lm to (about) 2000 lm, or from (about) 400 lm to (about) 1000 lm. For example, the at least one control unit may be configured to carry out such controlling of the at least one first light source and the at least one second light source. As mentioned, the first state of the at least one first light source and the at least one second light source may be employed during waking hours, which may be referred to as a waking hours state. A luminous flux of light emitted by the at least one first light source and/or the at least one second light source when in the first state being in a range from (about) 300 lumen (lm) to (about) 5000 lm may be a preferred luminous flux range for users during waking hours.

The at least one first light source and the at least one second light source, respectively, may be controlled by changing at least the luminous flux of the emitted light, between the first state and the second state of the at least one first light source and the at least one second light source, respectively, such that the luminous flux of light emitted by the at least one first light source and/or the at least one second light source when in the second state is below 200 lm, for example below 150 lm, or below 120 lm. For example, the at least one control unit may be configured to carry out such controlling of the at least one first light source and the at least one second light source. By means of such controlling of the at least one first light source and the at least one second light source, users may at a certain point in time, when the at least one first light source and the at least one second light source are in the second state thereof, only be able to perceive relatively little light from the at least one first light source and/or the at least one second light source, respectively. As per the foregoing description, the second state of the at least one first light source and the at least one second light source may be referred to as a sunset and/or sunrise state and a moonlight state, respectively, and may represent the color temperature of sunlight at sunset and/or sunrise and of moonlight, respectively. Thus, users may at a certain point in time, when the at least one first light source and the at least one second light source are in the second state thereof, only be able to perceive relatively little 'sunset and/or sunrise light' and 'moonlight', respectively.

The color temperature of light emitted by the at least one first light source and the at least one second light source, respectively, when in the first state may be the same, or substantially the same. By the color temperature of light emitted by the at least one first light source and the at least one second light source, respectively, when in the first state being the same, it is not necessarily meant that the color temperature of light emitted by the at least one first light source and the at least one second light source, respectively, when in the first state is exactly the same, buy they may differ, e.g., by a few percent. By means of the color temperature of light emitted by the at least one first light source and the at least one second light source, respectively, when in the first state being the same, or substantially the same, users may not perceive any difference in color temperature of the light emitted by the at least one first light source and the at least one second light source, respectively, when in the first state (e.g., the waking hours state).

The color temperature of light emitted by the at least one first light source and/or the at least one second light source when in the first state may for example be in a range from (about) 2500 K to (about) 3700 K, for example from (about) 2700 K to (about) 3600 K, or from (about) 2800 K to (about) 3550 K. As mentioned, the first state of the at least one first light source and the at least one second light source may be employed during waking hours, which may be referred to as a waking hours state. A color temperature of light emitted by the at least one first light source and/or the at least one second light source when in the first state in a range from 2500 K to 3700 K may be a preferred color temperature range for users during waking hours.

The color temperature of light emitted by the at least one first light source when in the second state may for example be below 2350 K, for example below 2250 K, or below 2220 K. Such color temperature may represent the color temperature of sunlight at sunset and/or sunrise.

The color temperature of light emitted by the at least one second light source when in the second state may for example be above 3750 K, for example above 3800 K, most preferably above 3900 K.

The color temperature of light emitted by the at least one second light source when in the second state may for example be in a range from (about) 3900 K to (about) 4300 K, for example, from (about) 4100 K to (about) 4200 K, or from (about) 4100 K to (about) 4150 K. Such color temperature may represent the color temperature of moonlight. The lighting system may comprise a single second light source. The reason for that the lighting system may comprise only one second light source is that Earth has only one moon.

In the context of the present application, by the at least one control unit being communicatively connected with the at least one first light source and with the at least one second light source, it is meant that the at least one control unit is directly communicatively connected, or indirectly communicatively connected, with the at least one first light source and with the at least one second light source, so as to allow for transmission of data, signals, messages, etc., from the at least one control unit to the at least one first light source and to the at least one second light source, and possibly also from the at least one first light source and the at least one second light source to the at least one control unit. For example, if the at least one control unit is directly communicatively connected with the at least one first light source and with the at least one second light source, the at least one control unit may communicate directly with the at least one first light source and with the at least one second light source using at least one communication link. If the at least one control unit is indirectly communicatively connected with the at least one first light source and with the at least one second light source, the at least one control unit may communicate with the at least one first light source and with the at least one second light source using, e.g., one or more intermediate elements or components, such as, for example, one or more intermediate transmit/receive units, wherein there may be at least one communication link between the at least one control unit and the one or more intermediate elements or components and at least one communication link between the one or more intermediate elements or components and the at least one first light source and the at least one second light source.

In the context of the present application, by a communication link it may be meant a wired communication link (e.g., comprising at least one optical waveguide) or a wireless communication link (e.g., a communication link over an air interface), or a hybrid communication link, which at least in part utilizes a wireless communication link and at least one communication link that at least in part utilizes a wired communication link.

In the context of the present application, by wireless communication link it is meant in principle any type of communicative link, connection or coupling utilizing one or more wireless techniques or means for effecting communication, such, as for example, at least one radio frequency (RF) communication link, and/or an infrared communication link (e.g., a communication link employing infrared light) or another type of free-space optical communication link (e.g., based on laser). Further in the context of the present application, by wired communication link it is meant in principle any type of communicative link, connection or coupling utilizing one or more non-wireless techniques or means for effecting communication, such, as for example, at least one optical waveguide, or optical transmission line (e.g., an optical fiber), and/or at least one electrical conductor (e.g., a cable or wire, e.g., a copper conductor or cable, or copper wire). Alternatively, "wired communication link" could be described as "non-wireless communication link", which hence may employ, for example, at least one optical waveguide, or optical transmission line, such as an optical fiber, and/or at least one cabling or wiring.

Each or any of the at least one first light source and the at least one second light source may be configured to emit light when operated or activated. Each or any of the at least one first light source and the at least one second light source may comprise at least one light-emitting element. Each or any of the at least one first light source and the at least one second light source or each or any one of the at least one light-emitting element may for example include or be constituted by a solid state light emitter. Examples of solid state light emitters include light-emitting diodes (LEDs) and organic LEDs (OLEDs). Solid state light emitters are relatively cost efficient light sources since they in general are relatively inexpensive and have a relatively high optical efficiency and a relatively long lifetime. However, in the context of the present application, the term "light-emitting element" or "light source" should be understood to mean substantially any device or element that is capable of emitting radiation in any region or combination of regions of the electromagnetic spectrum, for example the visible region, the infrared region, and/or the ultraviolet region, when activated e.g. by applying a potential difference across it or passing a current through it. Therefore, a light-emitting element or light source can have monochromatic, quasi-monochromatic, polychromatic or broadband spectral emission characteristics. Examples of light-emitting elements or light sources include semiconductor, organic, or polymer/polymeric LEDs, violet LEDs, blue LEDs, optically pumped phosphor coated LEDs, optically pumped nano-crystal LEDs or any other similar devices as would be readily understood by a person skilled in the art. Furthermore, the term light-emitting element or light source can, according to one or more embodiments of the present invention, mean a combination of the specific light-emitting element(s) which emit the radiation in combination with a housing or package within which the specific light-emitting element(s) is positioned or arranged. For example, the term light-emitting element or light source can encompass a bare LED die arranged in a housing, which may be referred to as a LED package. According to another example, the light-emitting element or light source may comprise a Chip Scale Package (CSP) LED, which may comprise a LED die directly attached to a substrate such as a PCB, and not via a sub-mount.

Each or any of the at least one first light source and the at least one second light source may include electrical and electronic functionalities, examples of which being protection circuits, color regulation circuits, dimming circuits, cut-off circuits, monitoring and temperature limiting circuits, wired communication circuits, wireless communication circuits.

The lighting system may comprise more than one control unit. If the lighting system comprises more than one control unit, at least some of the control units may be communicatively connected with each other. Control units may be directly or indirectly (e.g., via one or more intermediate elements or components) communicatively connected with each other so as to allow for transmission of data, signals, messages, etc., therebetween.

The lighting system may for example comprise a first control unit and a second control unit. The first control unit may be communicatively connected with the at least one first light source, and the second control unit may be communicatively connected with the at least one second light source. The first control unit may be configured to control each of the at least one first light source at least with respect to luminous flux of emitted light therefrom, and the second control unit may be configured to control each of the at least one second light source at least with respect to luminous flux of emitted light therefrom. The first control unit and the second control unit may be communicatively connected with each other.

The lighting system may comprise at least one sensor configured to sense at least one light characteristic of light emitted by at least one of the at least one first light source and the at least one second light source. The at least one light characteristic may for example comprise luminous flux and/or color temperature. The at least one sensor may be communicatively connected with the at least one control unit. The at least one control unit may be configured to control at least one or each of the at least one first light source and the at least one second light source at least with respect to luminous flux of emitted light therefrom based on sensed light characteristic of light emitted by the respective one or ones of the at least one first light source and the at least one second light source. For example, the lighting system may comprise at least one sensor configured to sense at least one light characteristic of light emitted by at least one of the at least one second light source, and the at least one control unit (e.g., the second control unit mentioned in the foregoing) may be configured to control at least one or each of the at least one second light source based on sensed light characteristic of light emitted by the respective one or ones of the at least one second light source.

With reference to the foregoing description, in the following some examples of the color temperature of the light emitted by the at least one first light source when in the first and second states and the color temperature of the light emitted by the at least one second light source when in the first and second states are provided. If the at least one first light source in the first and second states are denoted LS1_S1 and LS1_S2, respectively, and the at least one second light source in the first and second states are denoted LS2_S1 and LS2_S2, respectively, then the following non-limiting examples 1 to 6 of color temperatures may be contemplated:

EXAMPLE 1

LS1_S1: 3000 K; LS1_S2: 2300 K; LS2_S1: 3000 K; LS2_S2: 4150 K

EXAMPLE 2

LS1_S1: 3500 K; LS1_S2: 2200 K; LS2_S1: 3500 K; LS2_S2: 4100 K

EXAMPLE 3

LS1_S1: 3200 K; LS1_S2: 2100 K; LS2_S1: 3500 K; LS2_S2: 4150 K

EXAMPLE 4

LS1_S1: 2700 K; LS1_S2: 2300 K; LS2_S1: 3000 K; LS2_S2: 4200 K

EXAMPLE 5

LS1_S1: 3100 K; LS1_S2: 2100 K; LS2_S1: 3100 K; LS2_S2: 4100 K

EXAMPLE 6

LS1_S1: 3000 K; LS1_S2: 2000 K; LS2_S1: 3150 K; LS2_S2: 4150 K

According to a second aspect of the present invention, a method in a lighting system is provided. The lighting system comprises at least one first light source and at least one second light source. Each of the at least one first light source and the at least one second light source is controllable so as to emit light having at least a controllable luminous flux. Each of the at least one first light source and the at least one second light source is configured such that the color temperature of light emitted therefrom may vary. The method comprises controlling the at least one first light source and the at least one second light source, by changing at least the luminous flux of the emitted light, between at least a first state (or first setting, or "high" setting) and a second state (or second setting, or "low" setting) of the at least one first light source and the at least one second light source, respectively, such that, for each of the at least one first light source and the at least one second light source, the luminous flux of light emitted by the light source when in the second state is lower than the luminous flux of light emitted by the light source when in the first state. Light emitted by each of the at least one first light source when in the second state has a lower color temperature than light emitted by the first light source when in the first state, and light emitted by each of the at least one second light source when in the second state has a higher color temperature than light emitted by the second light source when in the first state.

According to a third aspect of the present invention, a computer program product is provided. The computer program product is configured to, when executed in a control unit comprised in a lighting system according to the first aspect of the present invention, perform a method according to the second aspect of the present invention.

According to a third aspect of the present invention, a computer-readable storage medium on which there is stored a computer program product is provided. The computer program product is configured to, when executed in a control unit comprised in a lighting system according to the first aspect of the present invention, perform a method according to the second aspect of the present invention.

The computer-readable storage medium may for example include a Digital Versatile Disc (DVD) or a floppy disk or any other suitable type of computer-readable means or computer-readable (digital) storage medium, such as, but not limited to, a nonvolatile memory, a hard disk drive, a Compact Disc (CD), a Flash memory, magnetic tape, a Universal Serial Bus (USB) memory device, a Zip drive, etc.

The at least one control unit may alternatively be referred to as at least one control and/or processing unit, or at least one control and/or processing unit, circuitry or module. A control unit may for example include or be constituted by any suitable central processing unit (CPU), microcontroller, digital signal processor (DSP), Application Specific Integrated Circuit (ASIC), Field Programmable Gate Array (FPGA), etc., or any combination thereof. A control unit may optionally be capable of executing software instructions stored in a computer program product e.g. in the form of a memory. The memory may for example be any combination of read and write memory (RAM) and read only memory (ROM). The memory may comprise persistent storage, which for example can be a magnetic memory, an optical memory, a solid state memory or a remotely mounted memory, or any combination thereof.

Further objects and advantages of the present invention are described in the following by means of exemplifying embodiments. It is noted that the present invention relates to all possible combinations of features recited in the claims. Further features of, and advantages with, the present invention will become apparent when studying the appended claims and the description herein. Those skilled in the art realize that different features of the present invention can be combined to create embodiments other than those described herein.

BRIEF DESCRIPTION OF THE DRAWINGS

Exemplifying embodiments of the invention will be described below with reference to the accompanying drawings.

Figure 1:
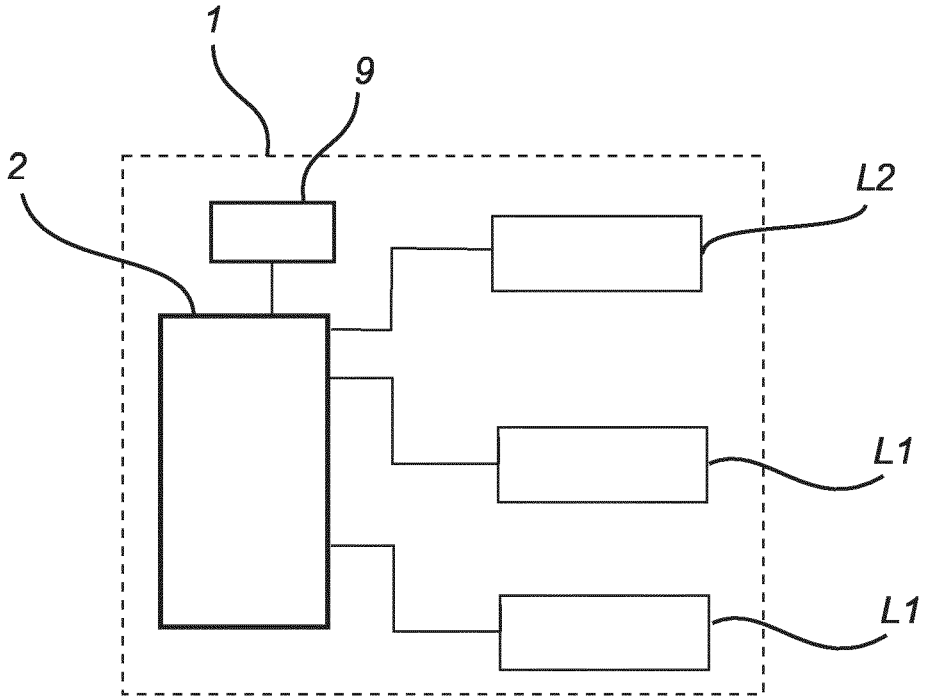
FIG. 1 is a schematic block diagram illustrating a lighting system according to an embodiment of the present invention.

All the figures are schematic, not necessarily to scale, and generally only show parts which are necessary in order to elucidate embodiments of the present invention, wherein other parts may be omitted or merely suggested.

DETAILED DESCRIPTION

The present invention will now be described hereinafter with reference to the accompanying drawings, in which exemplifying embodiments of the present invention are shown. The present invention may, however, be embodied in many different forms and should not be construed as limited to the embodiments of the present invention set forth herein; rather, these embodiments of the present invention are provided by way of example so that this disclosure will convey the scope of the invention to those skilled in the art. In the drawings, identical reference numerals denote the same or similar components having a same or similar function, unless specifically stated otherwise.

FIG. 1 is a schematic block diagram illustrating a lighting system 1 according to an embodiment of the present invention. The lighting system 1 comprises at least one first light source L1 and at least one second light source L2. According to the embodiment of the present invention illustrated in FIG. 1, the lighting system 1 comprises two first light sources L1 and one second light source L2. However, it is to be understood that the lighting system 1 could in principle comprise any number of first light sources L1 and any number of second light sources L2. Each of the first light sources L1 and the second light source L2 is controllable so as to emit light having at least a controllable luminous flux. Each of the first light sources L1 and the second light source L2 is configured such that the color temperature of light emitted therefrom may vary.

The lighting system 1 comprise a control unit (or control and processing unit, or processing unit) 2. The control unit 2 is communicatively connected with each of the first light sources L1 and with the second light source L2, as indicated in FIG. 1 by the solid lines connecting the control unit 2 with the first light sources L1 and the second light source L2. Even though the communicatively connection between the control unit 2 and the first light sources L1 and the second light source L2 is illustrated in FIG. 1 by solid lines, this does not necessarily mean that the communicative connection between the control unit 2 and the first light sources L1 and the second light source L2 is wired. In addition, or in alternative, the communicative connection between the control unit 2 and the first light sources L1 and the second light source L2 may be wireless. Any communicative connection between the control unit 2 and the first light sources L1 and the second light source L2 may comprise at least one wired communication link, a wireless communication link and/or a hybrid communication link.

The control unit 2 may control operation of the first light sources L1 and the second light source L2 for example by means of the control unit 2 transmitting at least one control signal, control signaling, or some other type of control message(s), which is received by the first light sources L1 and the second light source L2.

The control unit 2 is configured to control each of the first light sources L1 and the second light source L2 at least with respect to luminous flux of emitted light therefrom. The control unit 2 is configured to control the first light sources L1 and the second light source L2, respectively, by changing at least the luminous flux of the emitted light, between at least a first state and a second state of the first light sources L1 and the second light source L2, respectively, such that, for each of the first light sources L1 and the second light source L2, the luminous flux of light emitted by the light source when in the second state is lower than the luminous flux of light emitted by the light source when in the first state. The control unit 2 is configured to control the first light sources L1 and the second light source L2, respectively, between the first state and the second state of the first light sources L1 and the second light source L2, respectively, during respective time periods which are at least in part overlapping. Light emitted by each of the first light sources L1 when in the second state has a lower color temperature than light emitted by the first light source L1 when in the first state, and light emitted by the second light source L2 when in the second state has a higher color temperature than light emitted by the second light source L2 when in the first state.

The "first state" may in alternative be referred to as a "first setting", or "high setting" (e.g., with respect to the luminous flux of the emitted light). The "second state" may in alternative be referred to as a "second setting", or "low setting" (e.g., with respect to the luminous flux of the emitted light). For example, the first light sources L1 and the second light source L2, respectively, may be controlled by changing at least the luminous flux of the emitted light, between the first state and the second state of the first light sources L1 and the second light source L2, respectively, such that the luminous flux of light emitted by the first light sources L1 and the second light source L2, respectively, when in the first state, or high setting, is higher than when in the second state, or low setting. Thus, the luminous flux of light emitted by the first light sources L1 and the second light source L2, respectively, when in the first state, or high setting, may be higher than when in the second state, or low setting, for example.

Figure 2:
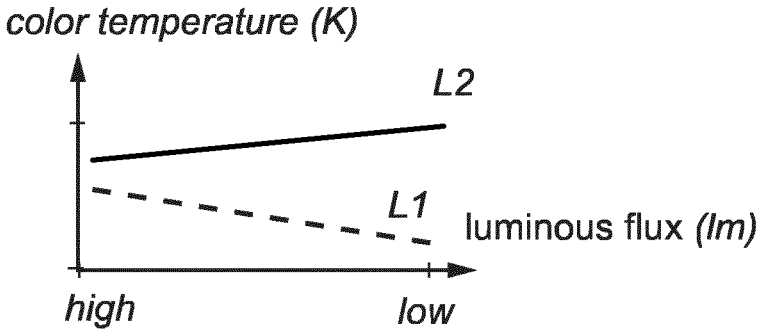
FIGS. 2 and 3 are schematic graphs illustrating color temperature as a function of luminous flux of light emitted by a first light source and a second light source in accordance with embodiments of the present invention.
Figure 3:
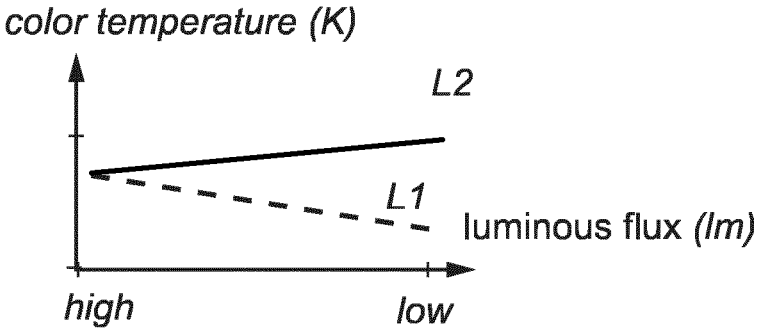

FIGS. 2 and 3 are schematic graphs illustrating color temperature as a function of luminous flux of light which may be emitted by each or any of the first light sources L1 (dashed line) and by the second light source L2 (solid line) in accordance with embodiments of the present invention. As illustrated in FIGS. 2 and 3, light emitted by the first light sources L1 when in the second state—or low setting (indicated by "low")—has a lower color temperature than light emitted by the first light source L1 when in the first state—or high setting (indicated by "high"), and light emitted by the second light source L2 when in the second state—or low setting ("low")—has a higher color temperature than light emitted by the second light source L2 when in the first state—or high setting ("high"). As further illustrated in FIGS. 2 and 3, the color temperature of light emitted by the first light source(s) L1 and the second light source L2, respectively, when in the first state—or high setting—may be different (cf. FIG. 2), or the same, or substantially the same (cf. FIG. 3).

The lighting system 1 may for example be implemented or arranged in a room (not shown in FIG. 1), such as, for example, a bedroom, wherein the first state of the first light sources L1 and the second light source L2 may be employed during waking hours, and the second state of the first light sources L1 and the second light source L2 may be employed during sleeping hours, usually during the night. For example, if the lighting system 1 is implemented or arranged in a room, such as, for example, a bedroom, the second light source L2 may be arranged in the ceiling of the room, and the first light sources L1 may be arranged on the floor of the room or on a table or nightstand or the like.

Figure 4:
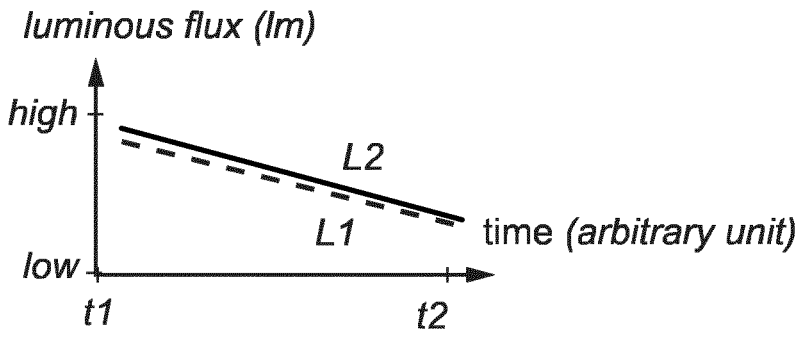
FIGS. 4 and 5 are schematic graphs illustrating luminous flux as a function of time of light emitted by a first light source and a second light source in accordance with embodiments of the present invention.
Figure 5:
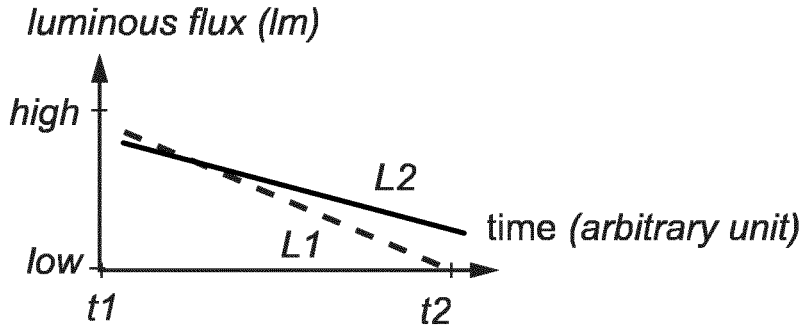

FIGS. 4 and 5 are schematic graphs illustrating luminous flux as a function of time (from time $t_1$ to time $t_2$) of light which may be emitted by each or any of the first light sources L1 (dashed line) and the second light source L2 (solid line) in accordance with embodiments of the present invention.

As illustrated in FIG. 4, the control unit 2 may be configured to control the first light sources L1 and the second light source L2, respectively, such that the luminous flux of the light emitted by the first light sources L1 and the second light source L2, respectively, when in the first state—or high setting ("high")—is substantially the same (e.g., differing only by a few percent at most), or the same.

As illustrated in FIG. 5, the control unit 2 may be configured to control the first light sources L1 and the second light source L2, respectively, by changing at least the luminous flux of the emitted light, between the first state and the second state of the first light sources L1 and the second light source L2, respectively, such that the luminous flux of light emitted by the first light sources L1 and the second light source L2, respectively, when in the first state is higher than when in the second state, and wherein the luminous flux of light emitted by the first light sources L1 when in the second state—or low setting ("low")—is zero, or substantially zero, and the luminous flux of light emitted by the second light source L2 when in the second state is non-zero.

Prior to time $t_1$ in FIGS. 4 and 5 (e.g., when the first light sources L1 and the second light source L2, respectively, are in the first state), the luminous flux of the light emitted by the first light sources L1 and the second light source L2, respectively, may be constant, or substantially constant (e.g., fluctuating by a few percent).

With further reference to FIG. 1, the lighting system 1 may comprise a clock module, or timing module, 9. The clock module 9 may be communicatively connected with the control unit 2. Any communicative connection between the control unit 2 and the clock module 9 may comprise at least one wired communication link, a wireless communication link and/or a hybrid communication link. It is to be understood that the functionality of the clock module 9 may possibly be integrated in the control unit 2, which hence may be configured to provide the functionality of the clock module 9. Thus, there may be no separate clock module 9 in the lighting system 1. The clock module 9 may be configured to control timing of the control unit 2 controlling each of the first light sources L1 and the second light source L2 between the first state and the second state of the first light sources L1 and the second light source L2, respectively.

The clock module 9 may be configured to cause the control unit 2 to control each of the first light sources L1 and the second light source L2 between the first state and the second state of the first light sources L1 and the second light source L2, respectively, at one or more certain times. The control unit 2 may control each of the first light sources L1 and the second light source L2 between the first state and the second state of the first light sources L1 and the second light source L2, respectively, at the same time, for example. The clock module 9 may be configured to cause the control unit 2 to control each of the first light sources L1 and the second light source L2 between the first state and the second state of the first light sources L1 and the second light source L2, respectively, at one or more points in time. For example, the clock module 9 may be configured to cause the control unit 2 to control each of the first light sources L1 and the second light source L2 from the first state to the second state of the first light sources L1 and the second light source L2, respectively, possibly at a certain point in time during a day, or during each of several days, e.g., at 23:00 hours (or at another time during the night). As per the foregoing description, the first state of the first light sources L1 and the second light source L2 may for example be employed during waking hours, which may be referred to as a waking hours state, and the second state of the first light sources L1 and the second light source L2 may for example be employed during sleeping hours, usually during the night.

In alternative or in addition to a clock module 9, the control unit 2 may be caused to control each of the first light sources L1 and the second light source L2 between the first state and the second state of the first light sources L1 and the second light source L2, respectively, at one or more certain times by means of a user control element (not shown in FIG. 1), which may be communicatively connected with the control unit 2 by way of at least one wired communication link, a wireless communication link and/or a hybrid communication link. The functionality of the user control element may possibly be integrated in the control unit 2, which hence may be configured to provide the functionality of the user control element, and in which case there may be no separate user control element provided. The user control element may be configured to permit a user to cause the control unit 2 to control each of the first light sources L1 and the second light source L2 between the first state and the second state of the first light sources L1 and the second light source L2, respectively, at one or more certain times, responsive to user input. The user input may for example be provided by the user by means of a control knob, a control slider, push buttons and/or another type of user interface which may be included in or constitute the user control element. User interfaces such as control knobs, control sliders, or push buttons may possibly be virtual ones implemented on, e.g., a touch-sensitive screen. Possibly, the clock module 9 may be overruled by means of the user providing user input.

Figure 6:
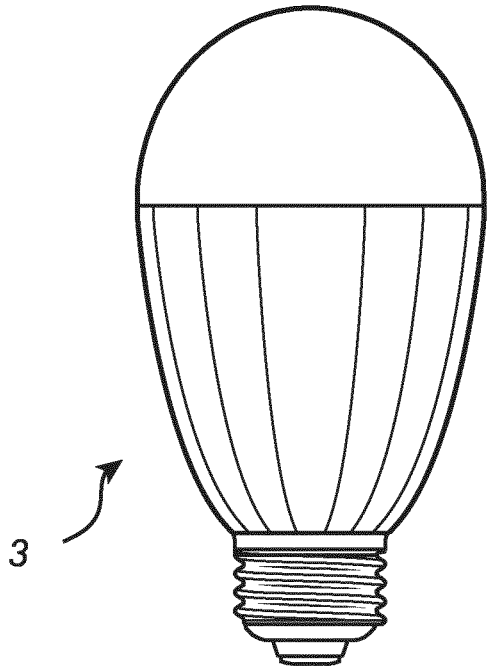
FIGS. 6 and 7 are schematic views of light sources in accordance with embodiments of the present invention.

FIG. 6 is a schematic view of a light source 3 according to an exemplifying embodiment of the present invention, in the form of a lamp 3. The illustrated light source 3 may comprise, or constitute, a first light source L1 or a second light source L2 as described in the foregoing. In accordance with the illustrated embodiment, the light source 3 comprises a so called "retrofit lamp" which is designed to have the appearance of a traditional incandescent light bulb and to be mounted in a conventional socket (e.g., an Edison screw base), with the light emitting filament wire being replaced for example with one or more LEDs.

Figure 7:
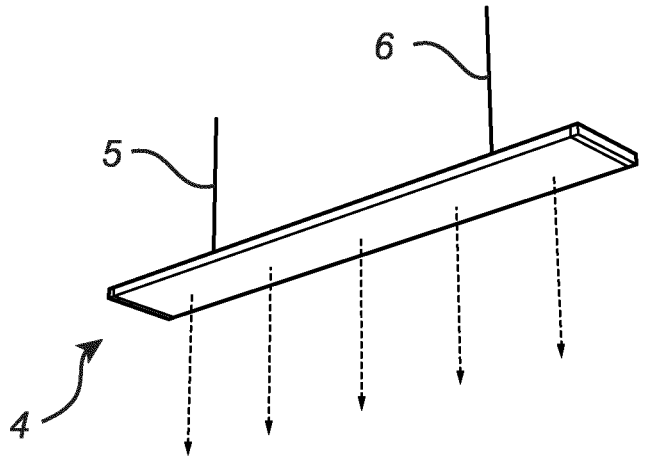

FIG. 7 is a schematic view of a light source 4 according to an exemplifying embodiment of the present invention, in the form of a luminaire 4. The illustrated light source 4 may comprise, or constitute, a first light source L1 or a second light source L2 as described in the foregoing. The light emitted by the luminaire 4 is indicated by the arrows in FIG. 7. As indicated in FIG. 7, the luminaire 4 is configured to be suspended for example from a ceiling (not shown in FIG. 7) by way of suspension means such as, for example, wires 5, 6.

Figure 8:
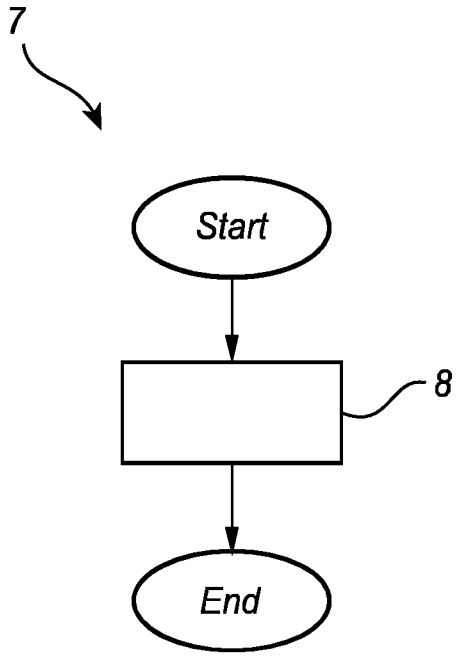
FIG. 8 is a schematic flow diagram of a method in a lighting system according to an embodiment of the present invention.

FIG. 8 is a schematic flow diagram of a method 7 in a lighting system according to an embodiment of the present invention. The lighting system comprises at least one first light source and at least one second light source. Each of the at least one first light source and the at least one second light source is controllable so as to emit light having at least a controllable luminous flux. Each of the at least one first light source and the at least one second light source is configured such that the color temperature of light emitted therefrom may vary.

The method 7 comprises controlling, at 8, the at least one first light source and the at least one second light source, by changing at least the luminous flux of the emitted light, between at least a first state (or first setting, or "high" setting) and a second state (or second setting, or "low" setting) of the at least one first light source and the at least one second light source, respectively, such that, for each of the at least one first light source and the at least one second light source, the luminous flux of light emitted by the light source when in the second state is lower than the luminous flux of light emitted by the light source when in the first state. The controlling of the at least one first light source and the at least one second light source, respectively, between the first state and the second state of the at least one first light source and the at least one second light source, respectively, is during respective time periods which are at least in part overlapping. Light emitted by each of the at least one first light source when in the second state has a lower color temperature than light emitted by the first light source when in the first state, and light emitted by each of the at least one second light source when in the second state has a higher color temperature than light emitted by the second light source when in the first state. The method 7 may then end.

In conclusion, a lighting system is disclosed, comprising at least one first light source and at least one second light source and at least one control unit. The at least one control unit is configured to control the at least one first light source and the at least one second light source, respectively, by changing at least the luminous flux of the emitted light, between at least a first state and a second state of the at least one first light source and the at least one second light source, respectively, such that, for each of the at least one first light source and the at least one second light source, the luminous flux of light emitted by the light source when in the second state is lower than the luminous flux of light emitted by the light source when in the first state. Light emitted by each of the at least one first light source when in the second state has a lower color temperature than light emitted by the first light source when in the first state and light emitted by each of the at least one second light source when in the second state has a higher color temperature than light emitted by the second light source when in the first state.

While the present invention has been illustrated in the appended drawings and the foregoing description, such illustration is to be considered illustrative or exemplifying and not restrictive; the present invention is not limited to the disclosed embodiments. Other variations to the disclosed embodiments can be understood and effected by those skilled in the art in practicing the claimed invention, from a study of the drawings, the disclosure, and the appended claims. In the appended claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A lighting system comprising:

at least one first light source and at least one second light source, wherein each of the at least one first light source and the at least one second light source is controllable so as to emit light having at least a controllable luminous flux, and wherein each of the at least one first light source and the at least one second light source is configured such that the color temperature of light emitted therefrom may vary; and at least one control unit communicatively connected with the at least one first light source and with the at least one second light source, wherein the at least one control unit is configured to control the at least one first light source and the at least one second light source, respectively, by changing at least the luminous flux of the emitted light, between at least a first state and a second state of the at least one first light source and the at least one second light source, respectively, such that, for each of the at least one first light source and the at least one second light source, the luminous flux of light emitted by the light source when in the second state is lower than the luminous flux of light emitted by the light source when in the first state;

wherein the at least one control unit is configured to control the at least one first light source and the at least one second light source, respectively, between the first state and the second state of the at least one first light source and the at least one second light source, respectively, during respective time periods which are at least in part overlapping;

wherein light emitted by each of the at least one first light source when in the second state has a lower color temperature than light emitted by the first light source when in the first state and light emitted by each of the at least one second light source when in the second state has a higher color temperature than light emitted by the second light source when in the first state.

2. A lighting system according to claim 1, wherein, the at least one control unit is configured to control the at least one first light source and the at least one second light source, respectively, between the first state and the second state of the at least one first light source and the at least one second light source, respectively, by continuously changing at least the luminous flux of the light emitted by the at least one first light source and the at least one second light source, respectively, wherein, as the luminous flux of the light emitted by the at least one first light source and the at least one second light source, respectively, is changed continuously, the color temperature of the light emitted by the at least one first light source and the at least one second light source, respectively, conforms to a black body locus.

3. A lighting system according to claim 1, wherein a difference between color temperature of the light emitted by each of the at least one first light source when in the first and second states is larger than a difference between color temperature of the light emitted by each of the at least one second light source when in the first and second states.

4. A lighting system according to claim 1, wherein the at least one control unit is configured to control the at least one first light source and the at least one second light source, respectively, such that the luminous flux of the light emitted by the at least one first light source and the at least one second light source, respectively, when in the first state is the same.

5. A lighting system according to claim 1, wherein the at least one control unit is configured to control the at least one first light source and the at least one second light source, respectively, by changing at least the luminous flux of the emitted light, between the first state and the second state of the at least one first light source and the at least one second light source, respectively, such that the luminous flux of light emitted by the at least one first light source and the at least one second light source, respectively, when in the first state is higher than when in the second state.

6. A lighting system according to claim 1, wherein the at least one control unit is configured to control the at least one first light source and the at least one second light source, respectively, by changing at least the luminous flux of the emitted light, between the first state and the second state of the at least one first light source and the at least one second light source, respectively, such that the luminous flux of light emitted by the at least one first light source and the at least one second light source, respectively, when in the first state is higher than when in the second state, wherein the luminous flux of light emitted by the at least one first light source when in the second state is zero and the luminous flux of light emitted by the at least one second light source when in the second state is non-zero.

7. A lighting system according to claim 1, wherein the at least one control unit is configured to control the at least one first light source and the at least one second light source, respectively, by changing at least the luminous flux of the emitted light, between the first state and the second state of the at least one first light source and the at least one second light source, respectively, such that the luminous flux of light emitted by the at least one first light source and/or the at least one second light source when in the first state is in a range from 300 lm to 5000 lm.

8. A lighting system according to claim 1, wherein the at least one control unit is configured to control the at least one first light source and the at least one second light source, respectively, by changing at least the luminous flux of the emitted light, between the first state and the second state of the at least one first light source and the at least one second light source, respectively, such that the luminous flux of light emitted by the at least one first light source and/or the at least one second light source when in the second state is below 200 lm.

9. A lighting system according to claim 1, wherein the color temperature of light emitted by the at least one first light source and the at least one second light source, respectively, when in the first state is the same.

10. A lighting system according to claim 1, wherein the color temperature of light emitted by the at least one first light source and/or the at least one second light source when in the first state is in a range from 2500 K to 3700 K.

11. A lighting system according to claim 1, wherein the color temperature of light emitted by the at least one first light source when in the second state is below 2350 K.

12. A lighting system according to claim 1, wherein the color temperature of light emitted by the at least one second light source when in the second state is above 3750 K.

13. A lighting system according to claim 1, wherein the color temperature of light emitted by the at least one second light source when in the second state is in a range from 3900 K to 4300 K.

14. A computer program product configured to, when executed in a control unit comprised in a lighting system according to claim 1.

15. A method in a lighting system the lighting system comprising at least one first light source and at least one second light source, wherein each of the at least one first light source and the at least one second light source is controllable so as to emit light having at least a controllable luminous flux, and wherein each of the at least one first light source and the at least one second light source is configured such that the color temperature of light emitted therefrom may vary, the method comprising:

controlling the at least one first light source and the at least one second light source, by changing at least the luminous flux of the emitted light, between at least a first state and a second state of the at least one first light source and the at least one second light source, respectively, such that, for each of the at least one first light source and the at least one second light source, the luminous flux of light emitted by the light source when in the second state is lower than the luminous flux of light emitted by the light source when in the first state;

wherein the controlling of the at least one first light source and the at least one second light source, respectively, between the first state and the second state of the at least one first light source and the at least one second light source, respectively, is during respective time periods which are at least in part overlapping;

wherein light emitted by each of the at least one first light source when in the second state has a lower color temperature than light emitted by the first light source when in the first state and light emitted by each of the at least one second light source when in the second state has a higher color temperature than light emitted by the second light source when in the first state.

* * * * *